US007252545B2

(12) United States Patent
Itou et al.

(10) Patent No.: US 7,252,545 B2
(45) Date of Patent: Aug. 7, 2007

(54) CONNECTOR SUITABLE FOR CONNECTION OF A COAXIAL CABLE

(75) Inventors: Yasukazu Itou, Tokyo (JP); Shinya Furukawa, Hiroshima (JP); Shingo Nakajima, Kanagawa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/413,677

(22) Filed: Apr. 28, 2006

(65) Prior Publication Data

US 2006/0246776 A1 Nov. 2, 2006

(30) Foreign Application Priority Data

Apr. 28, 2005 (JP) ..... 2005-131520
Jun. 1, 2005 (JP) ..... 2005-160988

(51) Int. Cl.
*H01R 9/05* (2006.01)

(52) U.S. Cl. ..... 439/578; 439/95; 439/585

(58) Field of Classification Search ..... 439/578, 439/95, 585, 98, 610
See application file for complete search history.

(56) References Cited

U.S. PATENT DOCUMENTS 5,433,633 A * 7/1995 Matsumoto et al. ..... 439/607
5,681,172 A * 10/1997 Moldenhauer ..... 439/95
5,691,506 A * 11/1997 Miyazaki et al. ..... 174/652
5,718,607 A * 2/1998 Murphy et al. ..... 439/610
7,114,989 B2 * 10/2006 Yin ..... 439/578

FOREIGN PATENT DOCUMENTS

| | | |
|---|---|---|
| JP | 10021977 | 1/1998 |
| JP | 2000058153 | 2/2000 |
| JP | 2001217019 | 8/2001 |
| JP | 2002324632 | 11/2002 |

* cited by examiner

*Primary Examiner*—Gary F. Paumen
(74) *Attorney, Agent, or Firm*—Collard & Roe, P.C.

(57) ABSTRACT

In a connector for connecting a coaxial cable having a center conductor and an outer conductor, a relay contact is connected between the outer conductor and a ground contact held by a housing. A signal contact is held by the housing and adapted to be connected to the center conductor. The relay contact includes a soldering portion and a connected portion coupled to the soldering portion. The soldering portion has a generally L-shaped section to define a recessed part and is soldered to the outer conductor in the state where the coaxial cable is received in the recessed part. The connected portion is adapted to be connected to the ground contact.

12 Claims, 12 Drawing Sheets

CONNECTOR SUITABLE FOR CONNECTION OF A COAXIAL CABLE

This application claims priority to prior Japanese patent applications JP 2005-131520 and 2005-160988, the disclosures of which are incorporated herein by reference.

BACKGROUND OF THE INVENTION

This invention relates to a connector for use in connecting a coaxial cable.

Coaxial cables having various diameters are known. A typical coaxial cable comprises a center conductor, an insulating inner sheath surrounding the center conductor, an outer conductor disposed outside the insulating inner sheath, and an insulating outer sheath surrounding the outer conductor. Each of the center conductor and the outer conductor may comprise a bundle of a large number of thin conductor wires. Alternatively, the center conductor and the outer conductor may comprise a relatively thick single wire and a braided wire, respectively.

Since the conductor comprising the thin conductor wires is soft, various techniques have been used in order to connect the coaxial cable. For example, in Japanese Unexamined Patent Application Publication (JP-A) No. 2000-58153, terminals are fixed to the center conductor and the outer conductor, respectively. The terminals are fixed by the use of a swaging technique. Specifically, the terminals are preliminarily provided with U-shaped parts having dimensions matching diameters of the center conductor and the outer conductor, respectively. After the conductors are inserted into the U-shaped parts, the U-shaped parts are swaged to be wound around the conductors. With the above-mentioned structure, the coaxial cable is connected via the terminals. Therefore, a connecting operation of the coaxial cable is easy.

However, since the conductors are inserted into the U-shaped parts of the terminals, various kinds (i.e., various sizes) of the terminals must be prepared in correspondence to various diameters of the coaxial cables. This brings about an increase in cost of the terminals.

On the other hand, Japanese Unexamined Patent Application Publication (JP-A) No. 2002-324632 discloses a connector which is for use in connecting a coaxial cable including a center conductor comprising a relatively thick single conductor wire and an outer conductor comprising a braided wire. The connector comprises a drain wire connecting member in addition to a signal contact and a ground contact held by the insulator. The signal contact is crimped and connected to the center conductor of the coaxial cable. The drain wire connecting member has a swaged part fixed and connected to the outer conductor of the coaxial cable by a swaging technique. After connected to the outer conductor, the drain wire connecting member is crimped and connected to the ground contact. With the above-mentioned structure, like connection of the center conductor to the signal contact, connection of the outer conductor comprising the braided wire to the ground contact can easily be performed by crimping.

However, since the drain wire connecting member is connected to the outer conductor by the swaging technique, various kinds of the terminals must be prepared in correspondence to various diameters of the coaxial cables. This brings about an increase in cost of the terminals.

In Japanese Unexamined Patent Application Publication (JP-A) No. 2001-217019, an outer conductor is extracted from a coaxial cable and forced into a Y-shaped cut portion of a ground contact to be connected thereto.

In Japanese Unexamined Patent Application Publication (JP-A) No. H10-21977, a plate-like grounding member extends over a number of coaxial cables arranged in parallel. The grounding member has a number of grounding plates corresponding to the cables in one-to-one correspondence. Each of the coaxial cables has an outer conductor comprising a braided wire, which is unbraided and extracted to be soldered to the grounding member.

In either case, however, a troublesome operation is required in order to extract the outer conductor from the coaxial cable.

SUMMARY OF THE INVENTION

It is therefore an object of this invention to provide a connector which is easily adaptable to various diameters of coaxial cables.

It is another object of this invention to provide a connector which can be connected to a coaxial cable by an easy operation.

Other objects of the present invention will become clear as the description proceeds.

According to an aspect of the present invention, there is provided a connector for connecting a coaxial cable comprising a center conductor and an outer conductor, the connector comprising a housing, a signal contact held by the housing and adapted to be connected to the center conductor, a ground contact held by the housing, and a relay contact connected between the outer conductor and the ground contact, the relay contact including a soldering portion having a generally L-shaped section to define a recessed part, the soldering portion being soldered to the outer conductor in the state where the coaxial cable is received in the recessed part, and a connected portion coupled to the soldering portion and adapted to be connected to the ground contact.

According to another aspect of the present invention, there is provided a connector for connecting a coaxial cable having a center conductor and an outer conductor, the connector comprising a first housing, a signal contact held by the first housing and having a signal connecting portion formed on the side of the coaxial cable to clamp the center conductor, a ground contact held by the first housing and having a ground connecting portion formed on the side of the coaxial cable to clamp the outer conductor by reactive force when the outer conductor is forced thereinto, a second housing releasably coupled to the first housing, and a ground plate held by the second housing and including a soldering portion to be soldered to the outer conductor of the coaxial cable, and a press-contact portion coupled to the soldering portion to be forced into the ground connecting portion.

According to still another aspect of the present invention, there is provided a connector for connecting a plurality of coaxial cables each of which comprises a center conductor and an outer conductor, the connector comprising a first housing, a plurality of signal contacts held by the first housing and each having a signal connecting portion formed on the side of the coaxial cable to clamp the center conductor, a plurality of ground contacts held by the first housing and each having a ground connecting portion formed on the side of the coaxial cable to clamp the outer conductor by reactive force when the outer conductor is forced thereinto, a second housing releasably coupled to the first housing, and a ground plate held by the second housing and including a plurality of soldering portions to be soldered to the outer conductors of the coaxial cables, respectively, and a plurality of press-contact portions coupled to the soldering portions to be forced into the ground connecting portions, respectively.

DESCRIPTION OF THE PREFERRED EMBODIMENTS

At first referring to FIGS. 1A and 1B, description will be made of a whole structure of a connector according to a first embodiment of this invention.

Figure 1A:
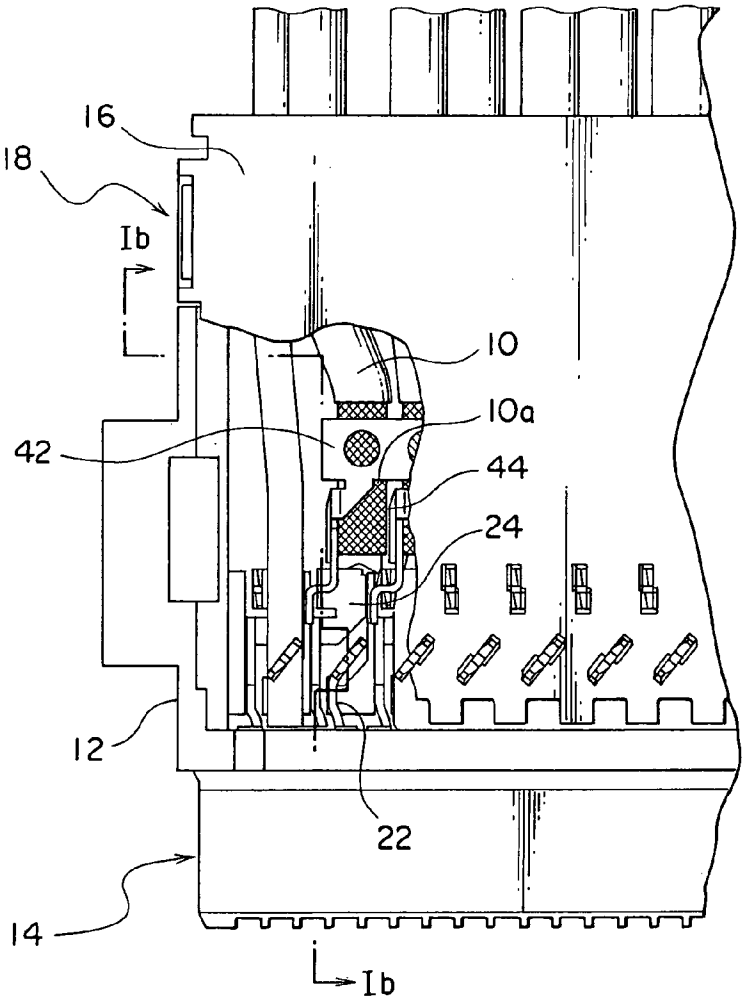
FIG. 1A is a partially-cutaway front view showing a connector according to a first embodiment of this invention together with coaxial cables.
Figure 1B:
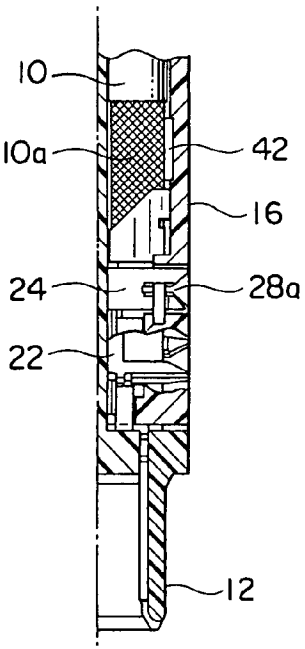
FIG. 1B is a sectional view taken along a line Ib-Ib in FIG. 1A.

The connector illustrated in FIGS. 1A and 1B is adapted to connect a plurality of coaxial cables 10 and comprises a base portion 14 including a base insulator 12 as a first housing, and a cover portion 18 including as a second housing a cover insulator 16 coupled to the base insulator 12. Herein, a combination of the base insulator 12 and the cover insulator 16 will be called a housing.

Figure 10:
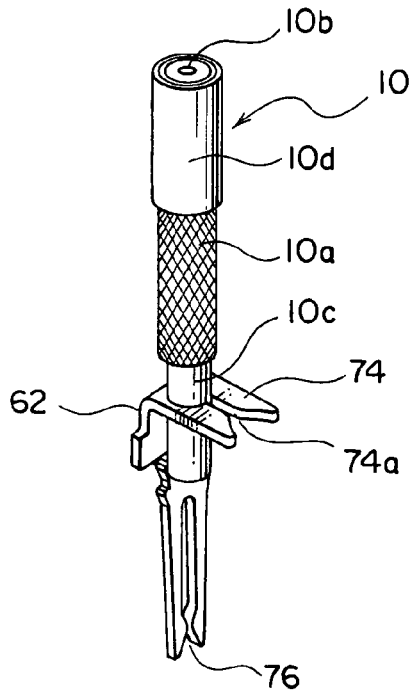
FIG. 10 is a perspective view showing a signal contact included in the connector in FIGS. 8 and 9 together with the coaxial cable.
Figure 11:
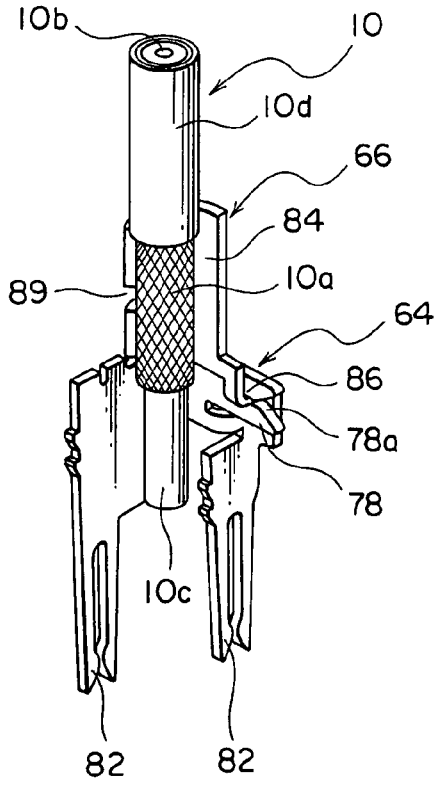
FIG. 11 is a perspective view showing a ground contact and a relay contact included in the connector in FIGS. 8 and 9 together with the coaxial cable.

As will be clear from FIGS. 10 and 11, each of the coaxial cables 10 includes a center conductor 10*c* of a relatively thick single conductor wire, an insulating inner sheath 10*b* surrounding the center conductor, an outer conductor 10*a* comprising a braided wire and disposed outside the insulating inner sheath, and an insulating outer sheath 10*d* surrounding the outer conductor 10*a* .

Figure 2A:
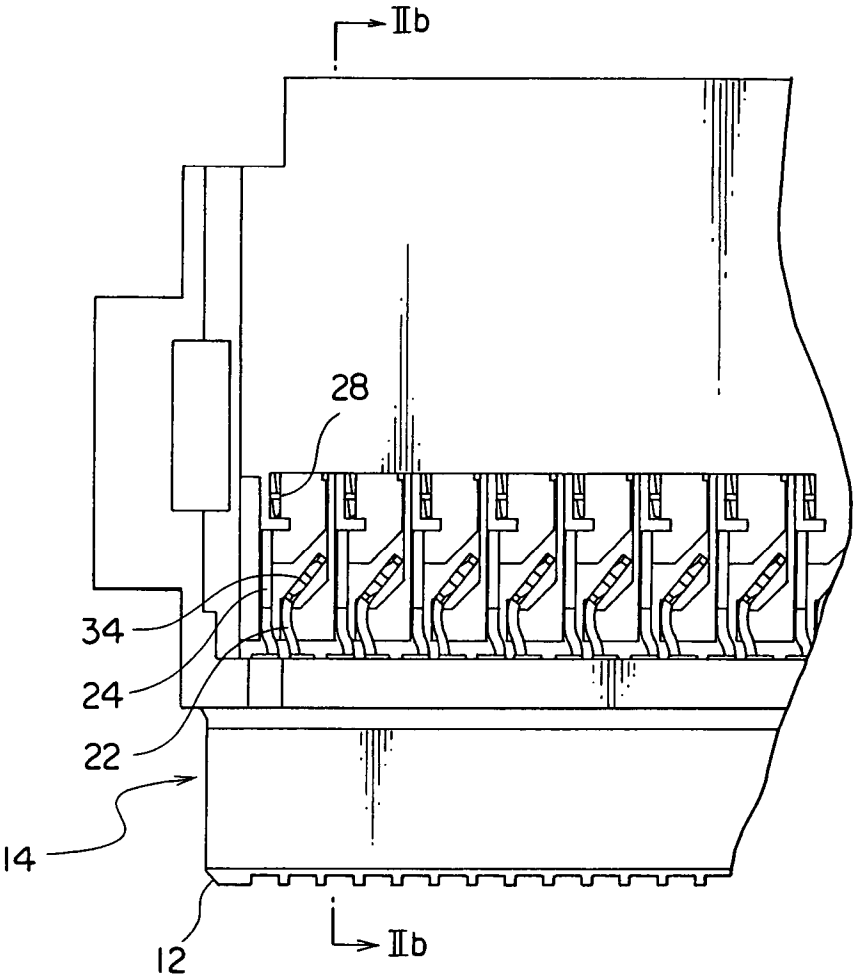
FIG. 2A is a front view of a base portion of the connector in FIG. 1A.
Figure 2B:
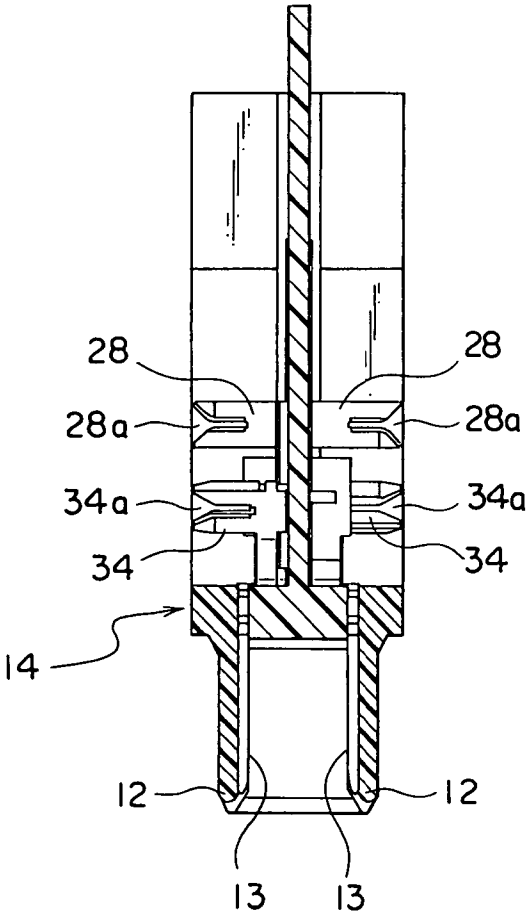
FIG. 2B is a sectional view taken along a line IIb-IIb in FIG. 2A.
Figure 3B:
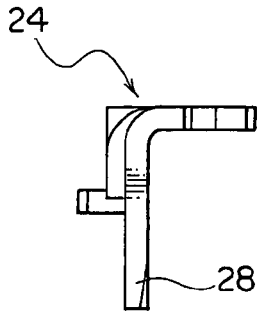
FIG. 3A to 3C are a front view, a plan view, and a side view of a ground contact included in the base portion in FIG. 2A, respectively.
Figure 3A:
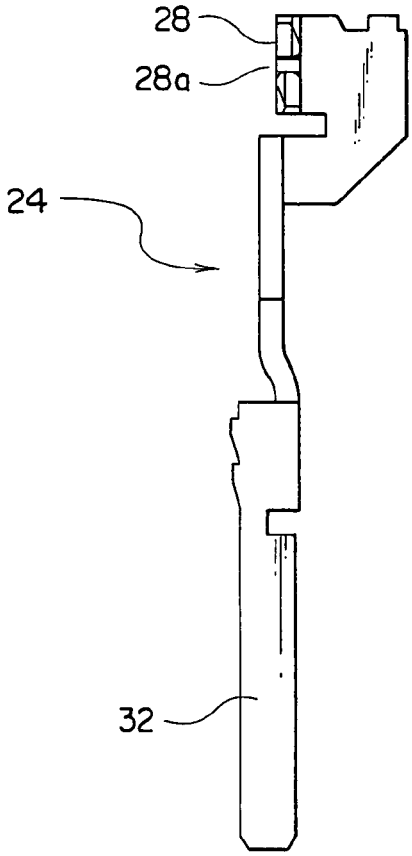
Figure 3C:
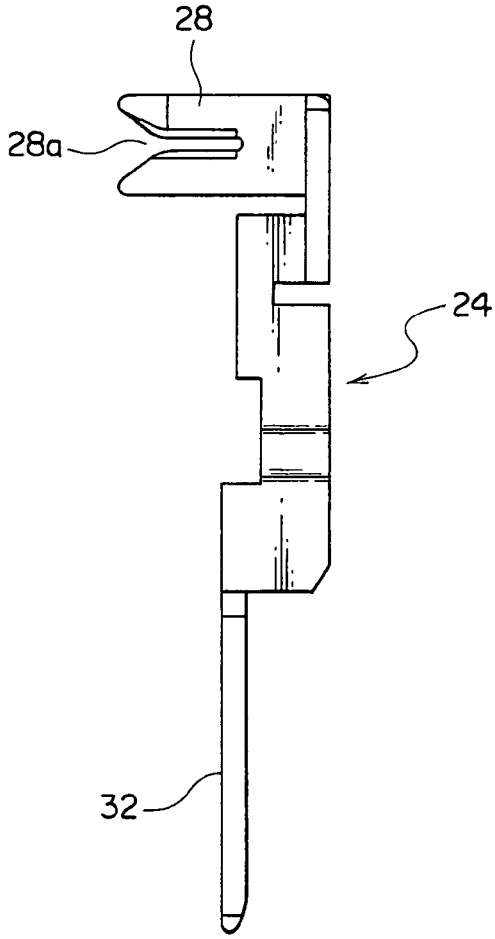
Figure 4C:
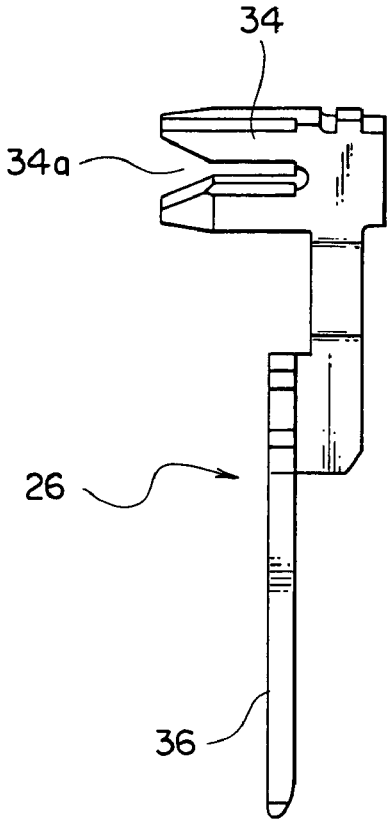
FIG. 4A to 4C are a front view, a plan view, and a side view of a signal contact included in the base portion in FIG. 2A, respectively.
Figure 4A:
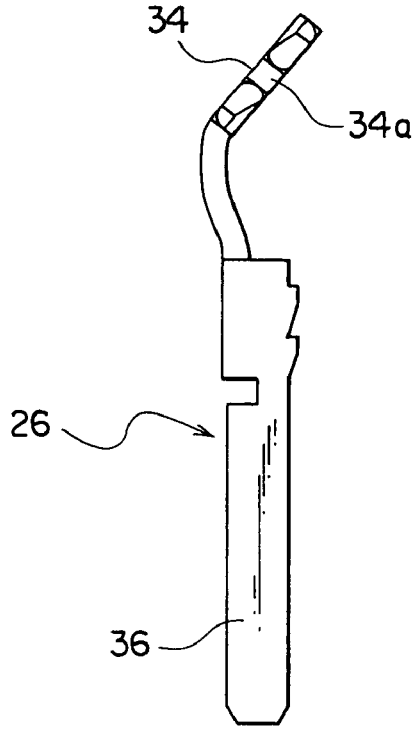
Figure 4B:
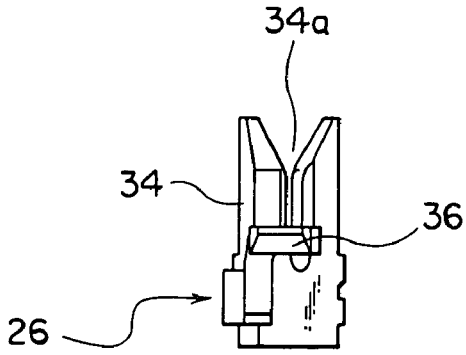

Referring to FIGS. 2A and 2B in addition to FIGS. 1A and 1B, the base portion 14 will be described.

In the base insulator 12, a plurality of conductive signal contacts 22 and a plurality of conductive ground contacts 24 are lined up or arranged in two rows and fixedly held. As will later become clear, the signal contacts 22 are electrically connected to the center conductors 10*b* of the coaxial cables 10, respectively. The ground contacts 24 are electrically connected to the outer conductors 10*a* of the coaxial cables 10, respectively.

Referring to FIGS. 3A to 3C and 4A to 4C in addition to FIGS. 2A and 2B, the ground contacts 24 and the signal contacts 22 will be described.

Each of the ground contacts 24 has one end provided with a connecting portion 28 to be indirectly connected to the outer conductor 10*a* of the coaxial cable 10 and the other end provided with a contacting portion 32 to be contacted with a ground contact of a mating connector (not shown). The connecting portion 28 has a Y-shaped cut portion 28*a*.

Figure 5:
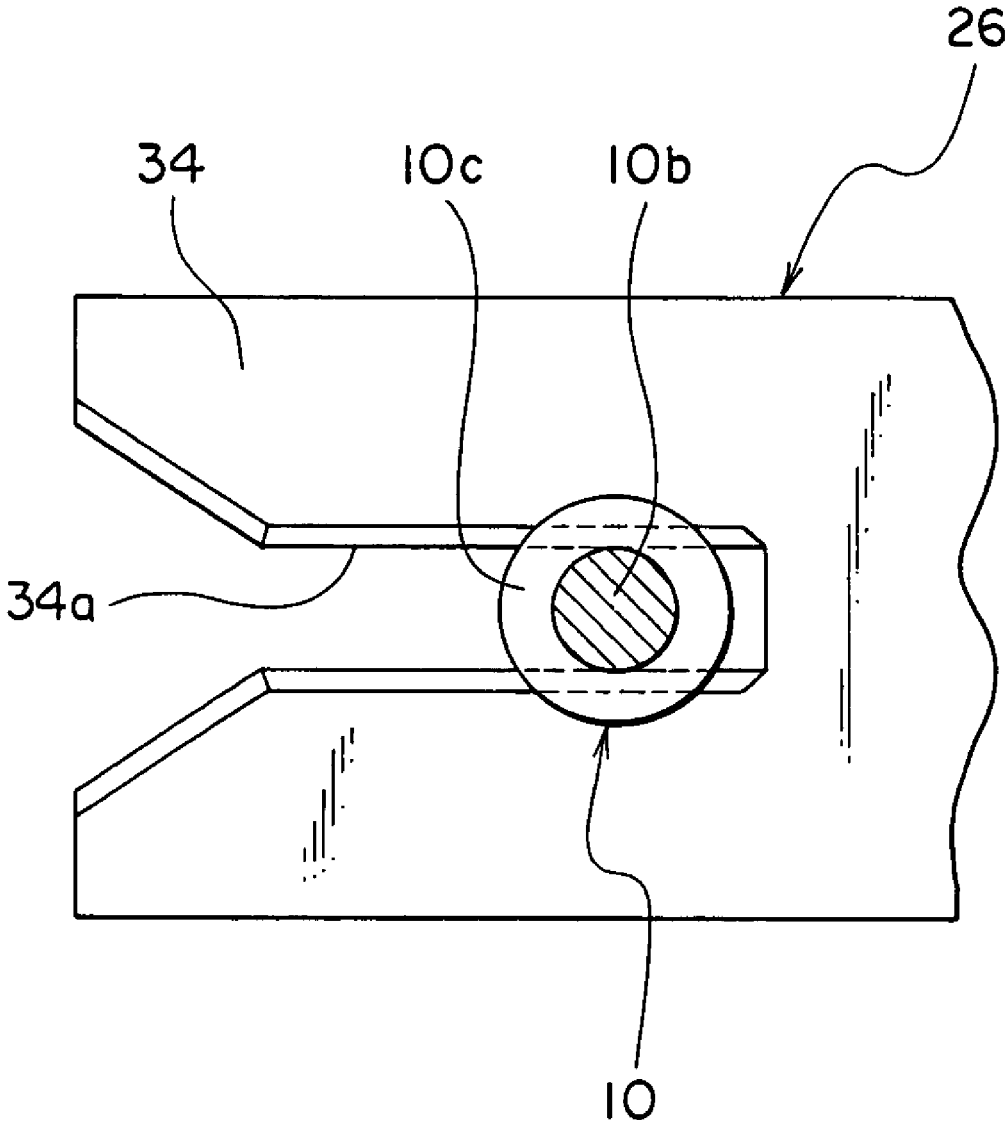
FIG. 5 is an enlarged view showing a characteristic part of the signal contact in FIGS. 4A to 4C together with the coaxial cable.

On the other hand, each of the signal contacts 22 has one end provided with a connecting portion 34 to be directly connected to the center conductor 10*b* of the coaxial cable 10 and the other end provided with a contacting portion 36 to be contacted with a signal contact of the mating connector. The connecting portion 34 has a Y-shaped cut portion 34*a*, like the connecting portion 28 of the ground contact 24. As illustrated in FIG. 5, the center conductor 10*b* of the coaxial cable 10, which is covered by the insulating inner sheath 10*c*, is forced into the cut portion 34*a*, the insulating inner sheath 10*c* is cut by an edge of the cut portion 34*a* so that the center conductor 10*b* is clamped by the connecting portion 34*a* of the signal contact 22 to be press-contacted and connected thereto. The cut portion 34*a* of the signal contact 22 is inclined with respect to an axial direction of the coaxial cable 10, taking the pitch into consideration.

Figure 7B:
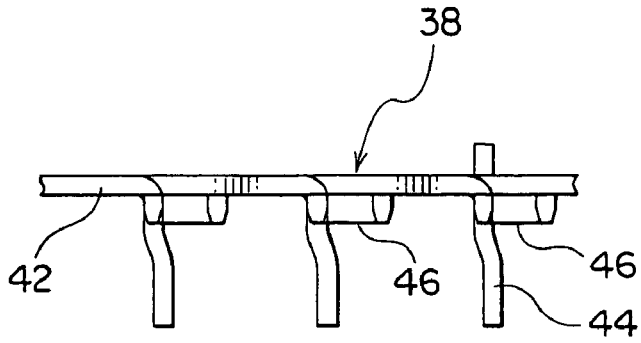
FIGS. 7A to 7C are a front view, a plan view, and a side view of a ground plate included in the cover portion in FIG. 1A, respectively.
Figure 7A:
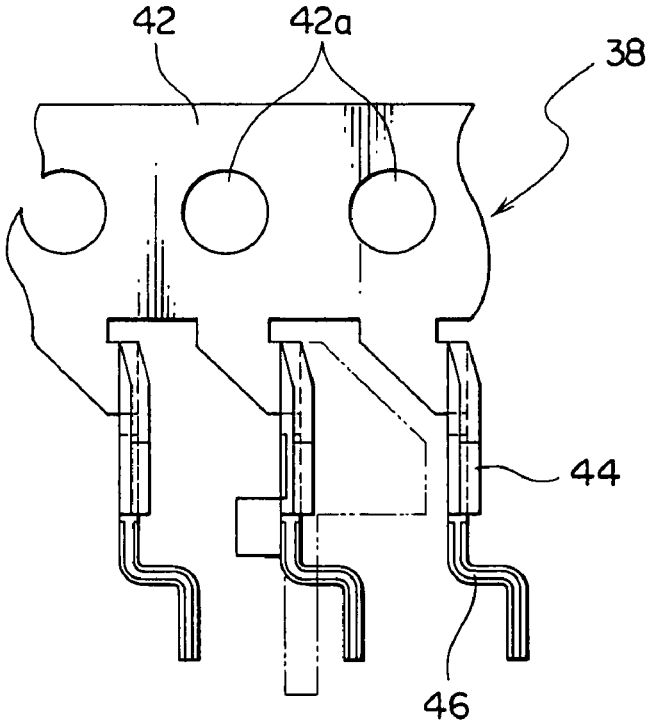
Figure 7C:
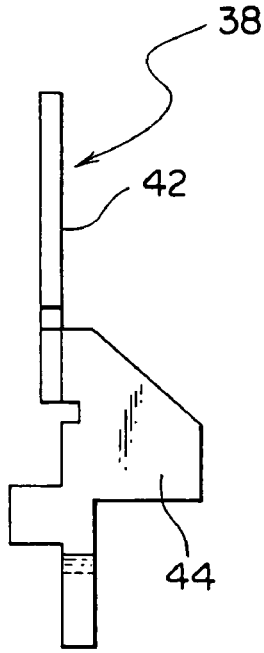

Referring to FIGS. 7A to 7C in addition to FIGS. 1A and 1B, the cover portion 18 will be described.

In the cover insulator 16, two conductive ground plates (only one being illustrated in the figure) 38 are fixedly held in correspondence to the rows of the ground contacts 24. Each of the ground plates 38 has a holding portion 42 extending along the row of the coaxial cables 10, a plurality of soldering portions 44 extending from the holding portion 42 to positions corresponding to the coaxial cables 10 in one-to-one correspondence, and a plurality of connected portions or press-contact portions 46 extending from the soldering portions 44, respectively. Each press-contact portion 46 is formed so as to be press-fitted into the cut portion 28*a* of the ground contact 24 when the cover insulator 16 is properly coupled to the base insulator 12. Preferably, the cover insulator 16 is locked to the base insulator 12 by an appropriate locking mechanism (not shown) in the state where the press-contact portions 46 are press-fitted into the cut portion 28*a*.

Figure 6:
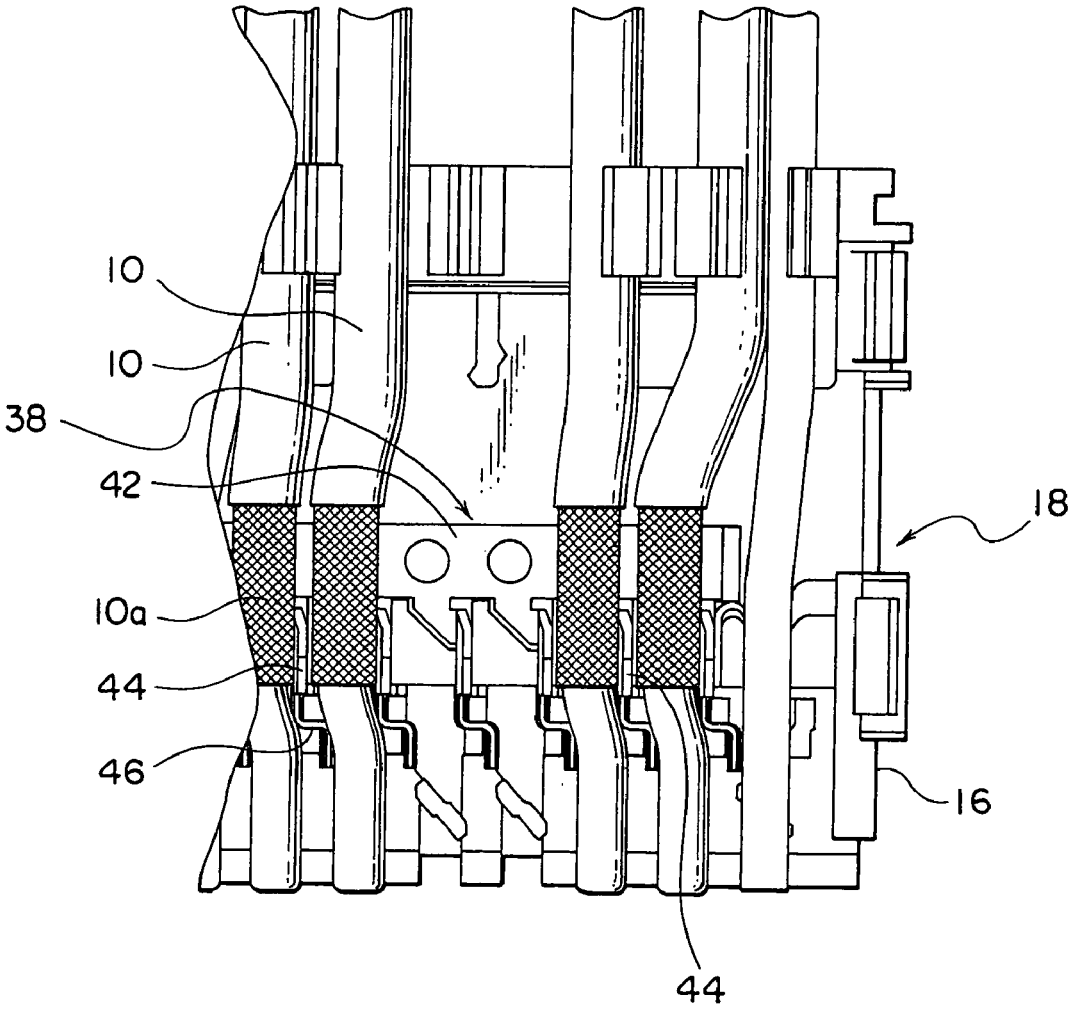
FIG. 6 is a front view showing a cover portion of the connector in FIG. 1A together with the coaxial cables.

The ground plate 38 is fixedly held by the cover insulator 16 by the use of a plurality of circular holes 42*a* of the holding portion 42. In FIG. 7A, the soldering portion 44 stands up on a front side of the drawing sheet. Before the cover insulator 16 is coupled to the base insulator 12, the outer conductor 10*a* of the coaxial cable 10 is disposed along the soldering portion 44 as shown in FIG. 6 and is soldered to the soldering portion 44 in a braided state. The outer conductor 10*a* is removed from the coaxial cable 10 at a part forward (downward in FIG. 6) from a soldered position.

From a base of the soldering portion 44, the press-contact portion 46 extends forward (downward in FIG. 7A) in a crank-like shape. When the cover insulator 16 is coupled to the base insulator 12, a laterally extending part of the press-contact portion 46 of a crank-like shape is forced into the cut portion 28*a* of the contact 24. Thus, the outer conductor 10*a* of the coaxial cable 10 is indirectly connected to the ground contact 24 through the ground plate 38. In other words, the ground plate 38 serves as a relay contact.

The ground plate 38 is integrally formed to extend over the coaxial cables 10. The soldering portion 44 and the press-contact portion 46 corresponding to each coaxial cable 10 are integrally formed. Therefore, when the press-contact portion 46 is forced into (press-fitted into) the cut portion 28*a* of the ground contact 24, wobbling or unstableness is avoided.

The soldering portion 44 may be formed into a generally L shape in section to define a recessed part. In this case, in the state where the coaxial cable 10 is received in the recessed part, the outer conductor 10*a* is connected to the soldering portion 44 by soldering. With this structure, the soldering portion 44 of a single kind is adaptable to various diameters of coaxial cables. It is therefore possible to reduce the cost.

In the embodiment described above, the base insulator 12 is formed to be symmetrical with respect to a center line as will be clear from FIG. 2B. Alternatively, the base insulator 12 may be formed only on one surface. The number of the coaxial cables to be connected is not limited.

Next referring to FIGS. 8 and 9, description will be made of a whole structure of a connector according to a second embodiment of this invention together with a mating connector 95.

Figure 8:
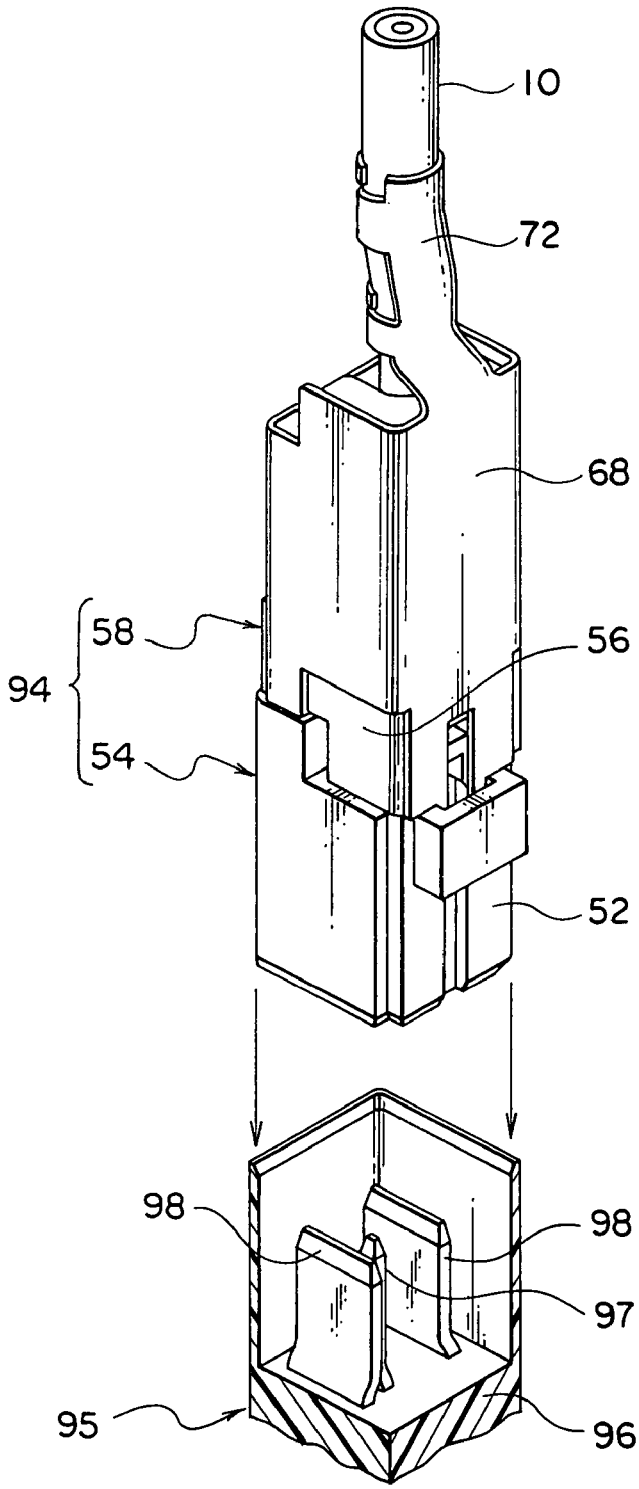
FIG. 8 is a perspective view showing a connector according to a second embodiment of this invention together with a coaxial cable and a mating connector partially cutaway.
Figure 9:
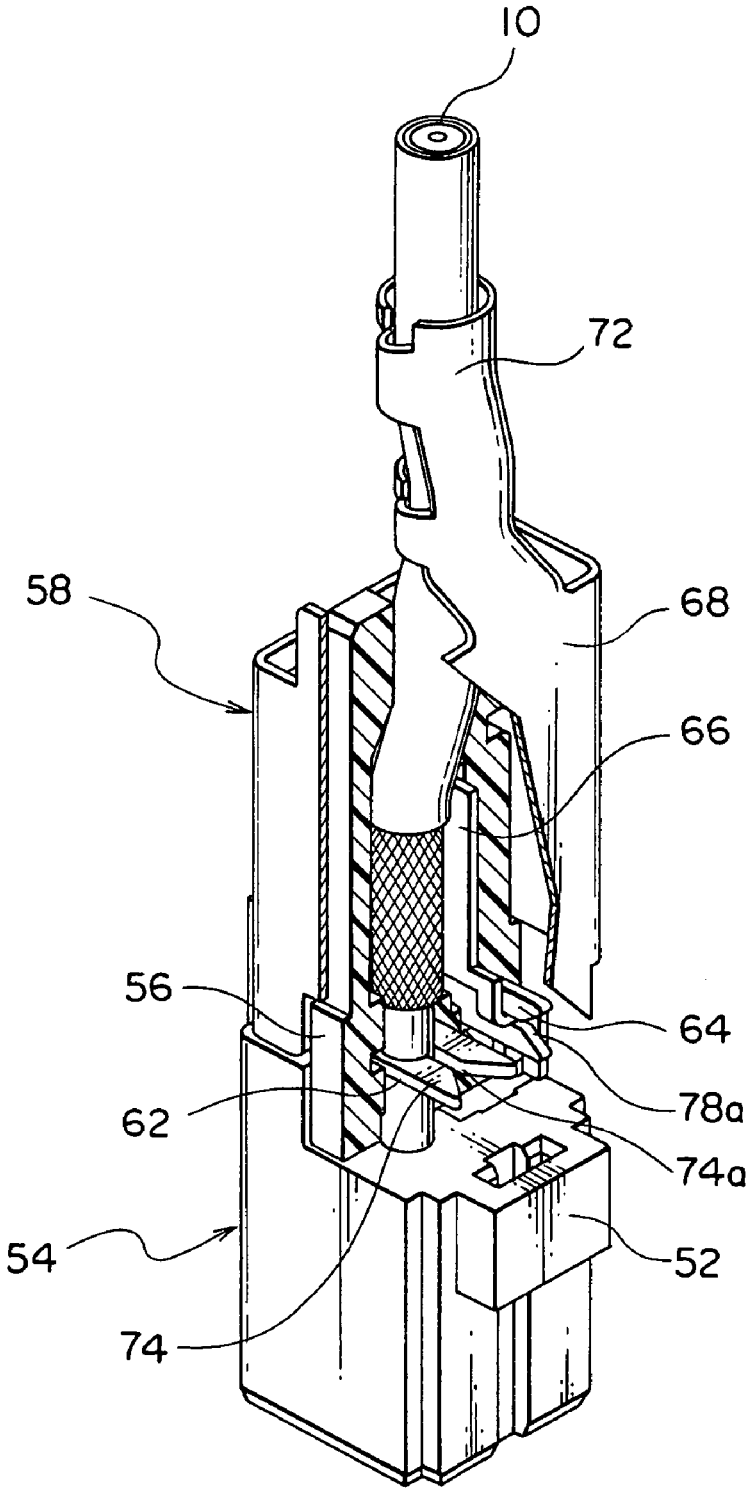
FIG. 9 is a partially-cutaway front view showing the connector in FIG. 8 together with the coaxial cable.

The connector illustrated in FIGS. 8 and 9 is a plug connector 94 for connecting a single coaxial cable 10 and comprises a base portion 54 including a base insulator 52 as a first housing, and a cover portion 58 including as a second housing a cover insulator 56 coupled to the base insulator 52. Herein, a combination of the base insulator 52 and the cover insulator 56 will be called a housing.

In the base insulator 52, a single conductive signal contact 62 and a single conductive ground contact 64 are fixedly held. Like the connector according to the first embodiment, the signal contact 62 is electrically connected to a center conductor 10*b* of the coaxial cable 10 while the ground contact 64 is electrically connected to an outer conductor 10*a* of the coaxial cable 10.

In the cover insulator 56, a conductive relay contact 66 is fixedly held. The relay contact 66 is soldered to the outer conductor 10*a* of the coaxial cable 10 as will later be described in detail.

The cover insulator 56 is covered with a conductive shell 68. The shell 68 has a cable holding portion 72 for holding the coaxial cable 10 outside its insulating outer sheath 10*d*.

Referring to FIG. 10 in addition to FIGS. 8 and 9, the signal contact 62 will be described.

The signal contact 62 has one end provided with a connecting portion 74 to be directly connected to the center conductor 10*b* of the coaxial cable 10 and the other end provided with a contacting portion 76 to be contacted with a signal contact of the mating connector 95. The connecting portion 74 has a Y-shaped cut portion 74*a*. When the center conductor 10 *b* of the coaxial cable 10, which is covered with an insulating inner sheath 10*c*, is forced into the cut portion 74*a*, the insulating inner sheath 10*c* is cut by an edge of the cut portion 74*a* so that the center conductor 10*b* is clamped by the connecting portion 74 of the signal contact 62 to be press-contacted and connected thereto.

Referring to FIG. 11 in addition to FIGS. 8 and 9, the ground contact 64 and the relay contact 66 will be described.

The ground contact 64 has one end provided with a connecting portion 78 to be indirectly connected to the outer conductor 10*a* of the coaxial cable 10 and the other end provided with two contacting portions 82 to be contacted with ground contacts 98 of the mating connector 95. The connecting portion 78 has a Y-shaped cut portion 78*a*, like the connecting portion 28 of the ground contact 24 in the first embodiment.

On the other hand, the relay contact 66 has a soldering portion 84 and a connected portion or press-contact portion 86 extending from the soldering portion 84. As seen from FIGS. 12A and 12B, the soldering portion 84 has a generally L-shaped section and defines a recessed part by two inner surfaces intersecting with each other. The connected portion 86 has a size and a shape suitable to be press-fitted into the cut portion 78*a* of the ground contact 64. Specifically, in FIG. 11, the relay contact 66 protrudes rightward from a lower part of the soldering portion 84, extends downward, then bends in a horizontal direction, and again extends downward. A horizontally extending part serves as the connected portion 86.

Figure 12A:
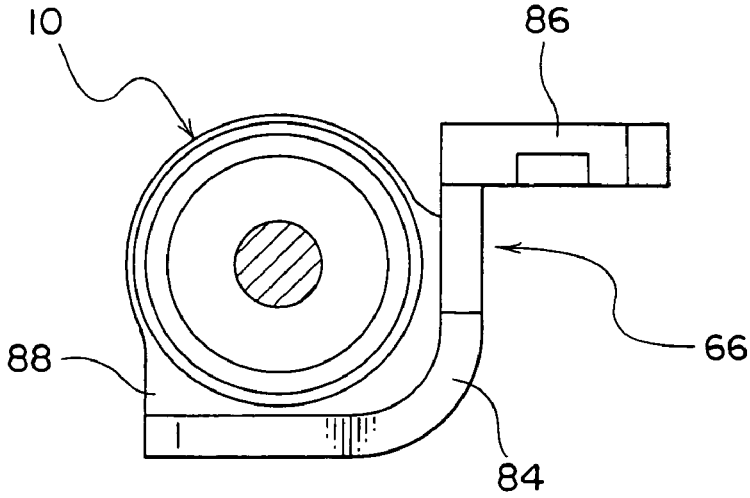
FIG. 12A is a sectional view showing the relay contact in FIG. 11 when the coaxial cable having a relatively large diameter is connected thereto.
Figure 12B:
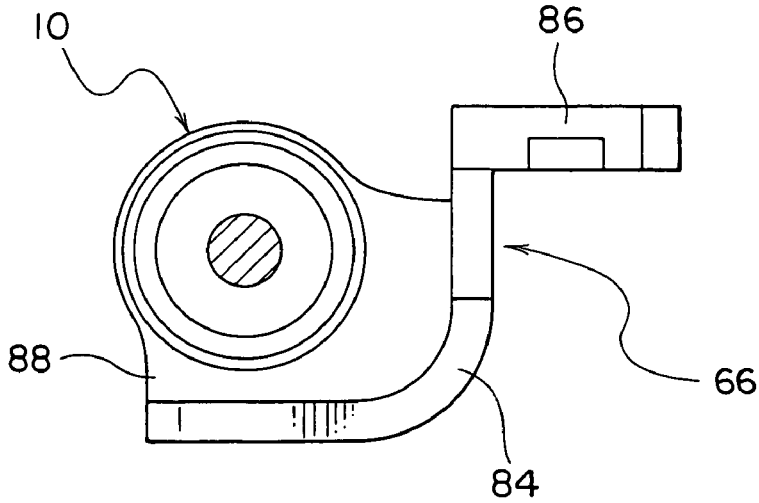
FIG. 12B is a sectional view showing the relay contact in FIG. 11 when the coaxial cable having a relatively small diameter is connected thereto.

Before the cover insulator 56 is coupled to the base insulator 52, the outer conductor 10*a* of the coaxial cable 10 is disposed in the recessed part of the soldering portion 84 as shown in FIGS. 12A and 12B and, in a braided state, soldered to the soldering portion 84 by the use of a solder 88. The soldering portion 84 is provided with a cut 89 as a checking portion in order to confirm the state of the solder 88. Preferably, an adjoining portion between the two inner surfaces of the soldering portion 84 has an arc shape in view of spreading of the solder 88.

The soldering portion 84 is formed into a generally L shape in section to define the recessed part and the outer conductor 10*a* is connected to the soldering portion 84 by soldering in the state where the coaxial cable 10 is received in the recessed part. Therefore, the soldering portion 84 of a single kind is adaptable to coaxial cables of various diameters, from a coaxial cable of a relatively large diameter illustrated in FIG. 12A to a coaxial cable having a relatively small diameter illustrated in FIG. 12B. It is therefore possible to reduce the cost. In case of the coaxial cable 10 having a relatively small diameter, the amount of the solder 88 is preferably increased to prevent decentering of the coaxial cable.

Figure 13A:
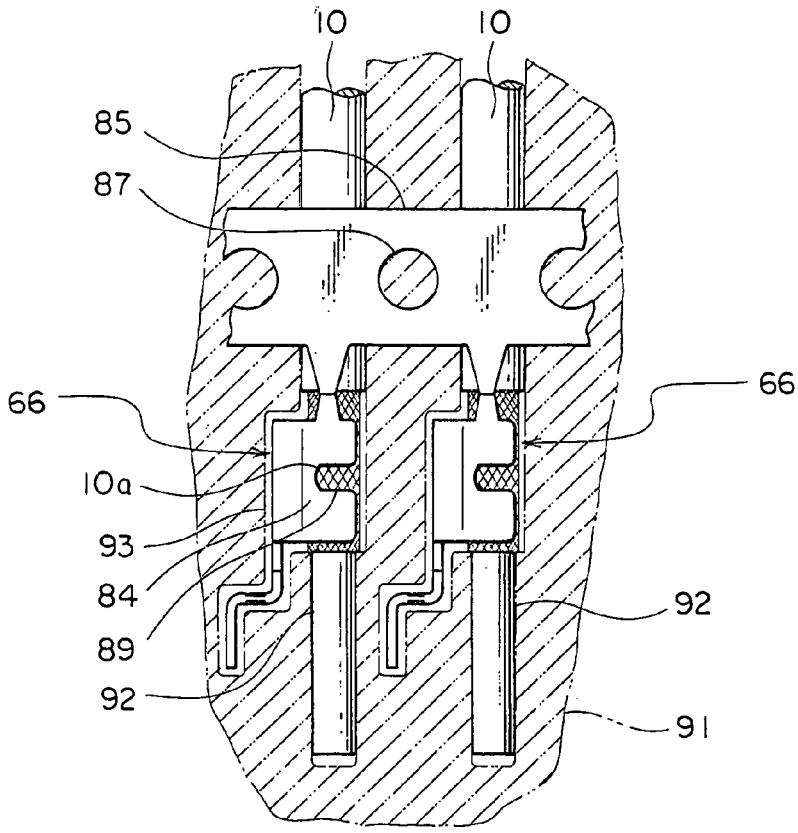
FIG. 13A is a view for describing an operation of connecting the coaxial cable to the relay contact illustrated in FIG. 11.
Figure 13B:
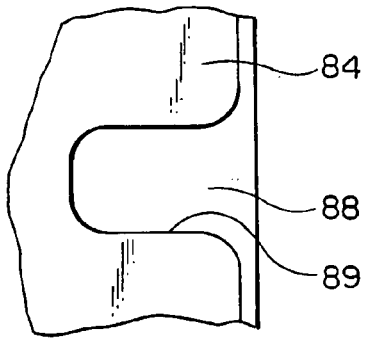
FIG. 13B is an enlarged view of a characteristic part in FIG. 13A.

Referring to FIGS. 13A and 13B, description will be made of an operation of connecting the coaxial cables 10 to the relay contacts 66 illustrated in FIG. 11. In FIGS. 13A and 13B, the relay contacts 66 are connected to a single carrier member 85. Each of the relay contacts 66 will be cut off from the carrier member 85 after the operation of connecting is finished.

The coaxial cable 10 and the relay contact 66 are fitted and fixed to a cable fixing groove 92 and a relay contact fixing groove 93 formed on a table 91, respectively. The solder 88 is supplied to the soldering portion 84 to solder the outer conductor 10*a* and the soldering portion 84. Thus, the coaxial cable 10 with the outer conductor 10*a* exposed and the relay contact 66 are fixed in positional relationship. A soldering condition can be confirmed via the cut 89 of the relay contact 66. A positioning hole for positioning the relay contact 66 is depicted by a reference numeral 87.

Turning back to FIGS. 8 and 9, description will be continued.

After the coaxial cable 10 is soldered, the connected portion 86 of the relay contact 66 is press-fitted into the cut portion 78*a* of the ground contact 64 to be press-contacted and connected thereto. The relay contact 66 is preliminarily connected to the outer conductor 10*a* of the coaxial cable 10. In this state, the connected portion 86 of the relay contact 66 is press-fitted to the cut portion 78*a* of the ground contact 64. Therefore, the connecting operation is easy, like press-fitting of the center conductor 10*b* of the coaxial cable 10 into the cut portion 74*a* of the signal contact 62.

Further, the state where the relay contact 66 is connected to the ground contact 64 is held by the cover insulator 56. Then, the shell 68 is placed thereon. Thus, the plug connector 94 illustrated in an upper part in FIG. 8 is obtained.

The plug connector 94 can be fitted and connected to the receptacle connector 95 illustrated in a lower part in FIG. 8. The receptacle connector 95 comprises an insulator 96, a conductive signal contact 97 held by the insulator 96, and two conductive ground contacts 98 held by the insulator 96.

When the plug connector 94 is fitted to the receptacle connector 95, the contacting portion 76 of the signal contact 74 of the plug connector 94 is contacted and fitted to the signal contact 97 of the receptacle connector 95. The contacting portions 82 of the ground contacts 64 of the plug connector 94 are contacted and fitted to the ground contacts 98 of the receptacle connector 95.

Although this invention has been described in conjunction with a few preferred embodiments thereof, this invention may be modified in various other manners within the scope of the appended claims.

What is claimed is:

1. A connector for connecting a coaxial cable comprising a center conductor and an outer conductor, the connector comprising:

a housing;

a signal contact held by the housing and adapted to be connected to the center conductor;

a ground contact held by the housing; and a relay contact connected between the outer conductor and the ground contact, the relay contact including:

a soldering portion having a generally L-shaped section to define a recessed part, the soldering portion being soldered to the outer conductor in the state where the coaxial cable is received in the recessed part; and a connected portion coupled to the soldering portion and adapted to be connected to the ground contact.

2. The connector according to claim 1, wherein the recessed part is defined by two surfaces of the soldering portion which intersect with each other.

3. The connector according to claim 1, wherein the signal contact is press-contacted and connected to the center conductor while the ground contact is press-contacted and connected to the connected portion.

4. The connector according to claim 1, wherein the soldering portion has a checking portion for confirming a soldering condition of the outer conductor.

5. The connector according to claim 4, wherein the checking portion comprises a cut portion formed in the soldering portion.

6. The connector according to claim 1, further comprising a shell fixed to the housing, the shell having a holding portion for holding the coaxial cable.

7. The connector according to claim 6, wherein the housing comprises:

a first housing holding the signal contact and the ground contact; and a second housing holding the relay contact and the shell.

8. A connector for connecting a coaxial cable having a center conductor and an outer conductor, the connector comprising:

a first housing;

a signal contact held by the first housing and having a signal connecting portion formed on the side of the coaxial cable to clamp the center conductor;

a ground contact held by the first housing and having a ground connecting portion formed on the side of the coaxial cable to clamp the outer conductor by reactive force when the outer conductor is forced thereinto;

a second housing releasably coupled to the first housing; and a ground plate held by the second housing and including:

a soldering portion to be soldered to the outer conductor of the coaxial cable; and a press-contact portion coupled to the soldering portion to be forced into the ground connecting portion.

9. The connector according to claim 8, wherein the first housing is formed on each of one surface and the other surface of a single substrate while the second housing is coupled to each of the one surface and the other surface.

10. A connector for connecting a plurality of coaxial cables each of which comprises a center conductor and an outer conductor, the connector comprising:

a first housing;

a plurality of signal contacts held by the first housing and each having a signal connecting portion formed on the side of the coaxial cable to clamp the center conductor;

a plurality of ground contacts held by the first housing and each having a ground connecting portion formed on the side of the coaxial cable to clamp the outer conductor by reactive force when the outer conductor is forced thereinto;

a second housing releasably coupled to the first housing; and a ground plate held by the second housing and including:

a plurality of soldering portions to be soldered to the outer conductors of the coaxial cables, respectively; and a plurality of press-contact portions coupled to the soldering portions to be forced into the ground connecting portions, respectively.

11. The connector according to claim 10, wherein the ground plate has a holding portion fixedly held by the second housing, the soldering portion being coupled to the holding portion.

12. The connector according to claim 10, wherein the ground contacts are lined up and held by the first housing, the press-contact portions being lined up and held by the second housing in correspondence to the ground contacts.

* * * * *